US010335634B2

(12) United States Patent
Safar

(10) Patent No.: US 10,335,634 B2
(45) Date of Patent: Jul. 2, 2019

(54) ROLLER EXERCISE DEVICE

(71) Applicant: Samir Hanna Safar, San Diego, CA (US)

(72) Inventor: Samir Hanna Safar, San Diego, CA (US)

(73) Assignee: Samir Hanna Safar, San Diego, CA (US)

( * ) Notice: Subject to any disclaimer, the term of this patent is extended or adjusted under 35 U.S.C. 154(b) by 169 days.

(21) Appl. No.: 15/641,257

(22) Filed: Jul. 4, 2017

(65) Prior Publication Data

US 2019/0009130 A1 Jan. 10, 2019

(51) Int. Cl.

| | |
|---|---|
| ***A63B 22/20*** | (2006.01) |
| ***A63B 26/00*** | (2006.01) |
| ***A61H 15/00*** | (2006.01) |
| ***A63B 22/00*** | (2006.01) |

(52) U.S. Cl.

CPC ..... *A63B 22/20* (2013.01); *A63B 22/0089* (2013.01); *A63B 26/003* (2013.01); *A61H 15/00* (2013.01); *A61H 2015/0014* (2013.01); *A61H 2201/1261* (2013.01); *A61H 2201/1671* (2013.01)

(58) Field of Classification Search

CPC ..... A63B 26/003; A63B 22/16; A63B 22/20; A63B 2037/065; A61H 15/00–0078; A61H 2015/0007–0064

See application file for complete search history.

(56) References Cited

U.S. PATENT DOCUMENTS

| | | | | |
|---|---|---|---|---|
| 5,573,485 | A * | 11/1996 | Geschwender | A63B 23/0233 482/112 |
| 6,231,489 | B1 * | 5/2001 | McBride | A63B 21/068 482/132 |
| 6,312,401 | B1 * | 11/2001 | Smith | A61H 1/0218 482/142 |
| 7,137,926 | B2 * | 11/2006 | Barrows | A63B 22/16 482/51 |
| 2004/0093710 | A1 * | 5/2004 | Sugimoto | A63B 45/02 29/426.1 |
| 2004/0158176 | A1 * | 8/2004 | Park | A61H 15/0078 601/18 |
| 2010/0274165 | A1 * | 10/2010 | Evans | A61H 15/00 601/122 |
| 2011/0152035 | A1 * | 6/2011 | Wahl | A63B 21/4039 482/51 |
| 2011/0300995 | A1 * | 12/2011 | Castiglione | A61H 15/0092 482/51 |

(Continued)

FOREIGN PATENT DOCUMENTS

| | | | | |
|---|---|---|---|---|
| CN | 203043430 U | * | 7/2013 | |
| WO | WO-2013001314 A2 | * | 1/2013 | A61H 15/00 |

*Primary Examiner* — Nyca T Nguyen

(74) *Attorney, Agent, or Firm* — Samir Hanna Safar

(57) ABSTRACT

The present invention relates to a novel roller exercise device that has the inherent advantages of using a roller and without the associated risks of imbalance and instability. The device can be customized to provide rolling features to cater to exercising needs of different organs, and is helpful for elderly users, in particular. The invention comprises a left roller support member, a right roller support member, a cylindrical core roller member, a bottom rest unit, a head rest unit.

9 Claims, 5 Drawing Sheets

(56) References Cited

U.S. PATENT DOCUMENTS

| | | | | |
|---|---|---|---|---|
| 2012/0071306 | A1* | 3/2012 | Bronston | A63B 21/02<br>482/139 |
| 2012/0322633 | A1* | 12/2012 | Holman | A63B 21/028<br>482/123 |
| 2013/0130872 | A1* | 5/2013 | Benne | A63B 21/16<br>482/121 |
| 2016/0136478 | A1* | 5/2016 | Yu | A63B 21/4039<br>482/121 |
| 2017/0014677 | A1* | 1/2017 | Lalaoua | A63B 23/0211 |
| 2017/0043219 | A1* | 2/2017 | Polinsky | A63B 26/003 |
| 2017/0216659 | A1* | 8/2017 | Lalaoua | A63B 21/0407 |
| 2018/0326254 | A1* | 11/2018 | Earls | A63B 21/4039 |

* cited by examiner

ROLLER EXERCISE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

FIELD OF THE INVENTION

The present invention belongs to the field of sporting apparatus and devices, and more particularly relates to a novel foam roller based device meant for carrying out physical workout and exercise.

BACKGROUND OF THE INVENTION

Foam rolling is a recently practiced self-myofascial release (SMR) exercise technique that is used by athletes and physical therapists to inhibit overactive muscles. This form of exercise has been found to be effective for many muscles, including: gastrocnemius, latissimus dorsi, piriformis, adductors, quadriceps, hamstrings, hip flexors, thoracic spine (trapezius and rhomboids). Generally, the equipment that is used for foam rolling consists of a foam cylinder of various sizes; commonly 30 centimeters long, 15 centimeters in diameter. However, longer foam rolls up to 90 centimeters in length are produced for exercising the back. A variety of foam roller densities are used often designated by different colors of the roller. Thus size and density of a roller is used to suit different exercise regimens and therapies and are utilized by physical therapists, physiotherapists and pilates practitioners in the performance of a number of physical exercises. These exercises facilitate balance, develop good posture and emphasize balance awareness.

To enhance core strength of back and abdominal region, a user typically lies on his or her back with the foam roller between the user's back and a floor surface. The foam roller is typically aligned along the user's spine.

These foam rollers are typically about 6 inches in diameter and about three feet long, and made of a semi rigid polyethylene foam or other semi rigid, yet marginally compressible plastic foam material so as not to be impermissibly uncomfortable to a user lying on the roller. Since the roller is typically about 6 inches in diameter, a person lying on her back is spaced a substantial distance from the floor. While this facilitates achieving balance when the user attempts to keep her arms off the floor, the distance from the floor makes it an uncomfortable experience for elderly users or users who are undergoing rehabilitation efforts.

Since foam rollers are cylindrical and inherently unstable, they challenge a user's sensory motor senses and many users are reluctant to try something unstable for the fear of injuries. Also elderly users are not able to use these rollers for a sufficient time so as to gain from the benefits of using it.

Therefore there is a need for a roller that assures a user that there is no fear of falling off onto the floor, while providing the benefits of using the roller, i.e. assisting with core strength and balance training, for sufficient duration so as to maximize its exercising benefits.

There is also a need for a roller that is suitable for users of different body types, weights, and physical conditions and caters to exercising different organs.

Below are given some of the known prior art.

US Patent application US20110152035 titled "Foam roller exercise device" discloses a foam roller exercise apparatus having first and second portions. The first portion may have a uniform cross-sectional shape, a first curved outer surface having a first radius of curvature, and a second curved outer surface spaced from the first curved outer surface and having a second radius of curvature. The second portion may be separable from the first portion and may have a uniform cross-sectional shape complimentary to the first portion.

Chinese patent reference CN 203043430 titled "All-Round Abdominal Exercise Machine Supine Board" discloses an all-round abdominal exercise machine supine board which comprises a rear support, a front support, a seat cushion, a backrest supporting frame and a backrest foam roller arranged on the backrest supporting frame. The all-round abdominal exercise machine supine board is novel in design and has both a supine board function and an abdominal exercise machine function, when supine movement is carried out, fixing bolts are pulled up, a backrest is tightly attached to the back to move together, when leaning-back movement is carried out, a limiting elastic connecting piece plays a role in damping, when a user sits up, the limiting elastic connecting piece plays a role in boosting, the abdominal exercise machine function is achieved, and when different adjusting holes where the fixing bolts are inserted in are located and fixed, the all-round abdominal exercise machine supine board has the supine board function.

U.S. Pat. No. 7,137,926 titled "Foam Roller" describes the exterior of an elongated exercise roller formed of a compressible, foam material, which instead of being cylindrical, has a portion that has a gentler curvature which makes balancing easier.

Patent application WO 2013001314 titled "Physical Exercise Apparatus" discloses a physical exercise apparatus comprising a hollow cylindrical device having first and second end regions, said first and second end regions being closable with closure means, at least one closure means being removable from the respective end region.

US Patent Application US 20120322633 entitled "Exercise roller with resistance bands" discloses an exercise apparatus includes a body roller and at least one resistance band. The body roller includes an interior channel. The resistance band passes through the interior channel of the body roller. Ends of the resistance band extend outward on each side of the body roller. The body roller facilitates applied pressure to a user's body. The resistance bands facilitate resistance training exercises by the user. The body roller provides a structural support for the resistance bands during the resistance training exercises.

US Patent Application US 20110300995 entitled "Exercise roller" discloses an exercise roller is comprised of at least two sub exercise roller units, the sub exercise roller units connected together to form a single exercise roller and separable to be usable as separate exercise rollers.

US Patent Application US 20130130872 entitled "Multi-Use Range of Motion Roller" discloses a multi-use range of motion roller that combines the traditional benefits of a foam roller with the added benefits of strength and resistance training.

US Patent Application US 20120071306 entitled "Portable Multipurpose Whole Body Exercise Device" discloses a portable multipurpose whole body exercise device which can be used for general fitness, Pilates-type, core strengthening, therapeutic, and rehabilitative exercises as well as stretching and physical therapy and which includes storable accessories that can be withdrawn from storage within the device and subsequently secured to the main tubular portion of the apparatus.

Despite various improvements and progress in the field, some of the major challenges continue to remain, mainly that of providing the user a reassuring experience that the using the roller will not cause the risk of a fall. None of the existing devices can help users to carry on exercise on the roller for a sufficiently long time. Further the same device cannot be utilized to use various kinds of rollers.

Accordingly, improvements are needed in the existing methods and structures that negate the above shortcomings in the existing systems.

The purpose and methodology of all the above inventions that are part of prior art do not envisage the unique embodiment of a roller based exercise device that can provide the benefits of a roller without the associated risk of instability. At the same time, the device provided by the present invention offers the flexibility of using various kinds of rollers in the same device.

The scope of the invention is to be determined by the terminology of the following description, claims, drawings and the legal equivalents thereof.

SUMMARY OF THE INVENTION

The present invention may be summarized, at least in part, with reference to its objects.

It is therefore a primary objective of the present invention to provide an exercising device that has the inherent advantages of using a roller and without the associated risks of imbalance and instability.

Another objective of the present invention is to provide a novel device that can be used to utilize a variety of rollers.

Another objective of the present invention is to provide an economical exercising device that can be adjusted to suit different users.

A further objective of the present invention is to provide a novel exercising device that can be customized to provide rolling features to cater to different organs.

Yet another object of the present invention is to help a weak or elderly or heavy user, stay on the roller device for a sufficiently long duration without the risk of a fall.

The invention described herein is a novel roller exercise device, that can placed on a support surface, comprising:

a pair of roller support members, designated as a left roller support member and a right roller support member, each roller support member having a semi-cylindrical configuration and a flat side surface, such that the flat side surface is placed on the support surface;

a cylindrical core roller member configured to support at least a portion of a user's body above the support surface during an exercise activity, wherein the cylindrical core roller member is centrally and parallelly positioned in between the left roller support member and the right roller support member;

a bottom rest unit, said bottom rest unit further comprising of:

a cushion member, a cushion base member, a plurality of carriage wheels, a plurality of carriage track members, a plurality of bottom rest support members, a position locking means;

a head rest unit configured with a central depression, a core roller support member, configured as cylindrical elongated member, having a first end and a second end, wherein the core roller support member is coaxially positioned and connected to the head rest unit at the first end, and the cylindrical core roller member at the second end, such that cylindrical core roller member is coaxially rotatable around the core roller support member;

a base support assembly, said base support assembly further comprising a plurality of structural support members, wherein each structural support member has at least one flat surface configured to rest on the support surface and said plurality of structural support members are positioned below and non-removably attached to the left roller support member, the right roller support member, the cylindrical core roller member, the bottom rest unit and the head rest unit at predetermined locations.

The above summary is intended to illustrate exemplary embodiments of the invention, which will be best understood in conjunction with the detailed description to follow, and are not intended to limit the scope of the invention.

Additional objects and embodiments of the invention will be set forth in part in the description which follows, and in part will become apparent to those skilled in the art upon examination of the following, or may be learned by practice of the invention. Thus these and other objects of the present invention will be more readily apparent when considered in reference to the following description and when taken in conjunction with the accompanying drawings.

Figure 1:
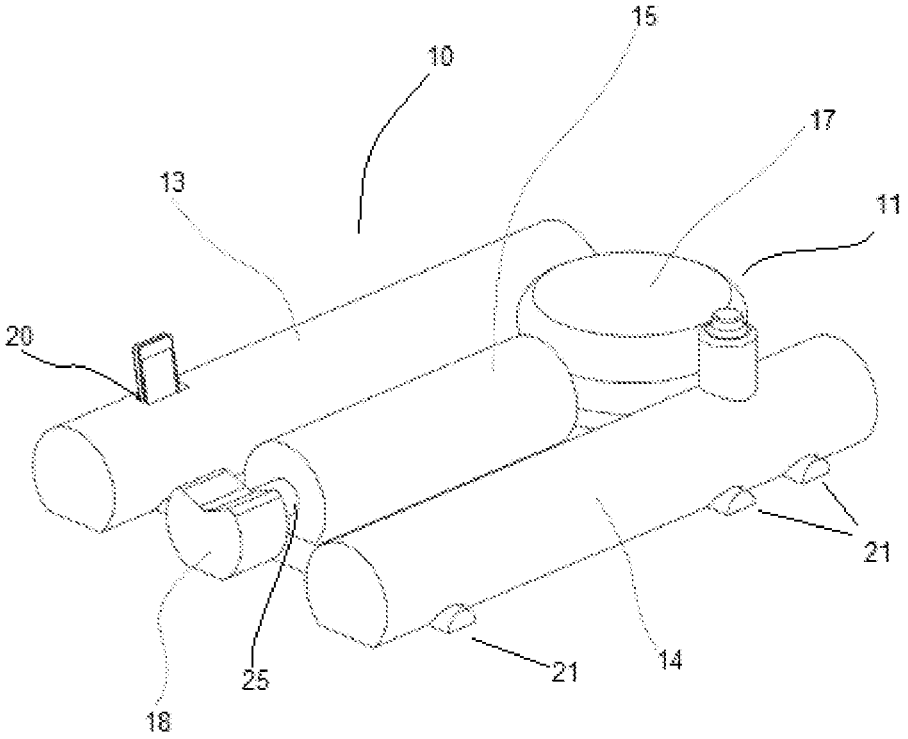
FIG. 1 is an illustrative diagram depicting the roller exercise device in an embodiment of the present invention.

It should be understood that drawings are for the purpose of illustrating the concepts of the invention and are not to scale.

LIST OF REFERENCE NUMBERING

10 labels a roller exercise device
11 labels a bottom rest unit
13 labels a right roller support member
14 labels a left roller support member
15 labels a cylindrical core roller member
16 labels a cushion base member

17 labels a cushion member
18 labels a head rest unit
20 labels an accessory slot
21 labels a plurality of structural support members
22 labels a plurality of carriage wheels
23 labels a plurality of carriage track members
24 labels a plurality of bottom rest support members
25 labels a core roller support member
26 labels a cylindrical core roller member in an alternate embodiment

DETAILED DESCRIPTION OF THE INVENTION

As required, detailed embodiments of the present invention are disclosed herein. However, it is to be understood that the disclosed embodiments are merely exemplary of an invention that may be embodied in various and alternative forms. Therefore, specific functional details disclosed herein are not to be interpreted as limiting, but merely as a representative basis for the claims and/or as a representative basis for teaching one skilled in the art to variously employ the present invention.

The following description is presented to enable any person skilled in the art to make and use the invention, and is provided in the context of particular applications of the invention and their requirements.

The invention described herein thus comprises a novel roller exercise device that offers the benefits of a roller without the discomfort of imbalance.

With reference to FIG. 1, 10 depicts a roller exercise device in accordance with an embodiment of the present invention. 10 comprises of a cylindrical core roller member 15, disposed in the centre of a right roller support member 13, a left roller support member 14, a bottom rest unit 11, a head rest unit 18 and a plurality of structural support members 21.

In a main embodiment of the present invention, the longitudinal axis of the cylindrical core roller member 15 is parallel to the longitudinal axis of the right roller support member 13 and the longitudinal axis of the left roller support member 14. The left roller support member 14 and the right roller support member 13 have a substantially semi-cylindrical configuration and a flat side surface, such that the flat side surface is placed on the support surface. They may also have an optional slot or cavity configured to receive personal belongings of a user, such as a mobile phone, glasses or keys. The cylindrical core roller member 10 is coaxially disposed around a core roller support member 25 and is freely rotatable. The core roller support member 25 is configured as a cylindrical elongated member, having a first end and a second end. The core roller support member 25 is coaxially positioned to connect the head rest unit 18 and the cylindrical core roller member 15 at both its ends. The first end of the core roller support member 25 is integrated with the head rest unit 18. The second end of the core roller support member 25 is disposed within the cylindrical core roller member 15 and is rotatably and removably secured within it using a feastening means such as a snap fit knob, such that the cylindrical core roller member 15 is able to freely rotate around the core roller support member 25.

The bottom rest unit 11 is provided on the upper portion along the longitudinal axis of the cylindrical core roller member 15. The bottom rest unit 11 further comprises of a cushion base member 16, a cushion member 17, a plurality of carriage wheels 22, a plurality of carriage track members 23, a plurality of bottom rest support members 24, and a position locking means 25 (not shown in FIG. 1).

The cushion member 17 is disposed vertically above the cushion base member 16. The cushion member 17 may be attached to the cushion base member 16 by removable or non-removable means. The position of the bottom rest unit 11 may be adjusted horizontally or vertically according to requirements of a user.

The head rest unit 18 is provided on the lower portion along the longitudinal axis of the cylindrical core roller member 15. The head rest unit 18 may be provided with a slight central depression to conform to the shape of a user's neck, for providing support. A plurality of structural support members 21, each member having a semi-circular cross sectional area and at least one flat surface, are connected below the right roller support member 13, the left roller support member 14, the cylindrical core roller member 15, the bottom rest unit 11 and the head rest unit 18, such that the flat surface rests on the support surface.

Figure 2:
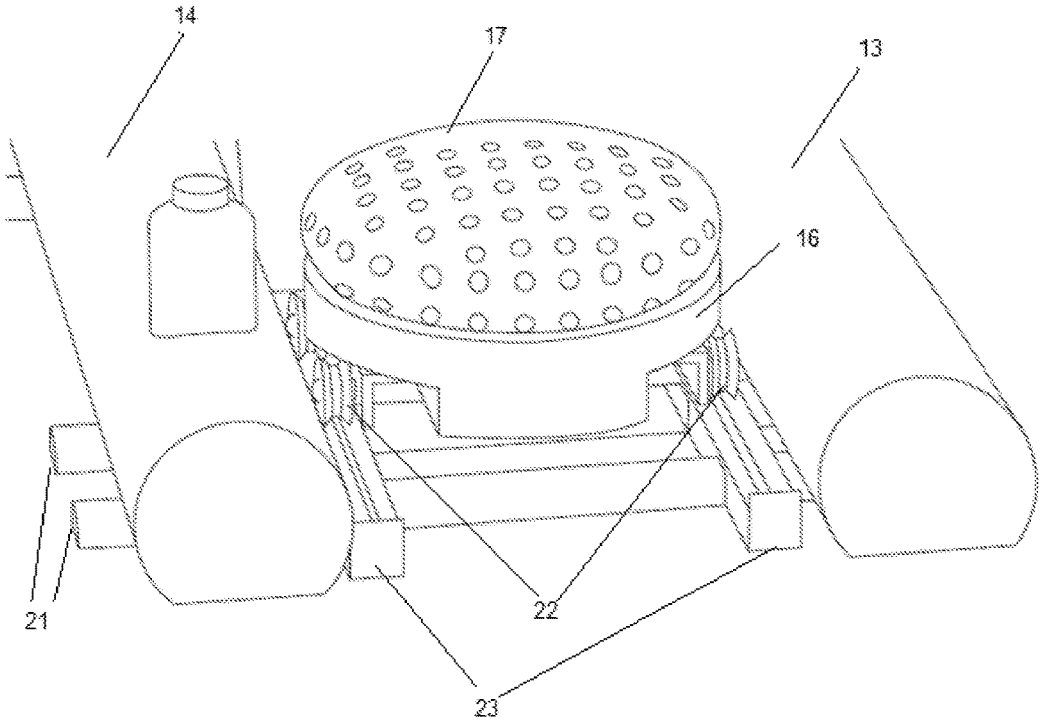
FIG. 2 is an enlarged partial perspective view depicting an embodiment of the present invention.

FIG. 2 displays a partial view of the upper portion of the present invention. The cushion member 17 is characterized by a textural surface, as in an alternate embodiment. The horizontal position of the bottom rest unit 11 can be adjusted by moving it along the carriage wheels 22 along the carriage track members 23.

Figure 3:
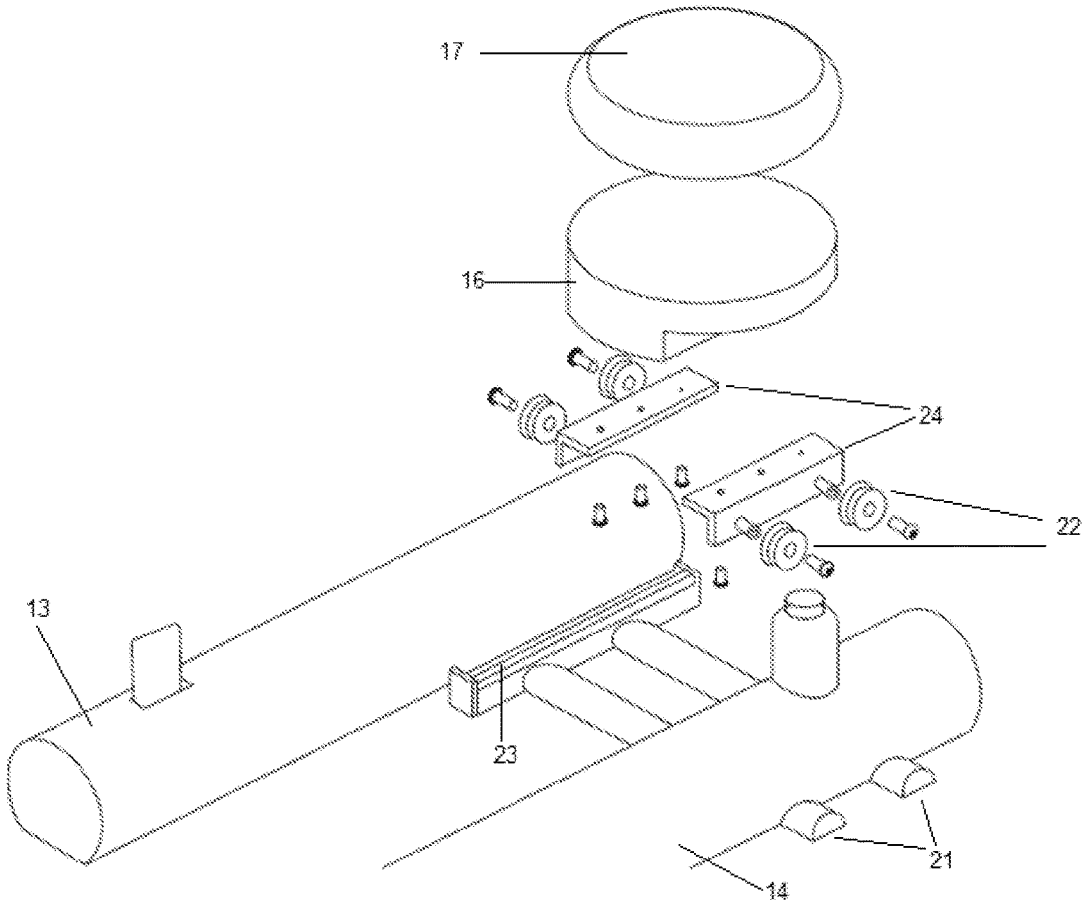
FIG. 3 is an enlarged partial perspective view depicting an embodiment of the present invention.

FIG. 3 displays a partial exploded view of the upper portion of the present invention. The cylindrical core roller member 15 is not shown in this drawing. The cushion member 17 is disposed vertically above the cushion base member 16. The cushion base member 16 is connected to a plurality of bottom rest support members 24. A plurality of carriage wheels 22 are connected to the plurality of bottom rest support members 24 and engages with a plurality of carriage track members 23. To adjust the horizontal position of the bottom rest unit 11, it is possible to move the positions of the bottom rest support members 24 and the carriage track members 23 and secure them using mechanical fastening means such as screws, nuts, bolts and thereby act as a position locking means.

Figure 4:
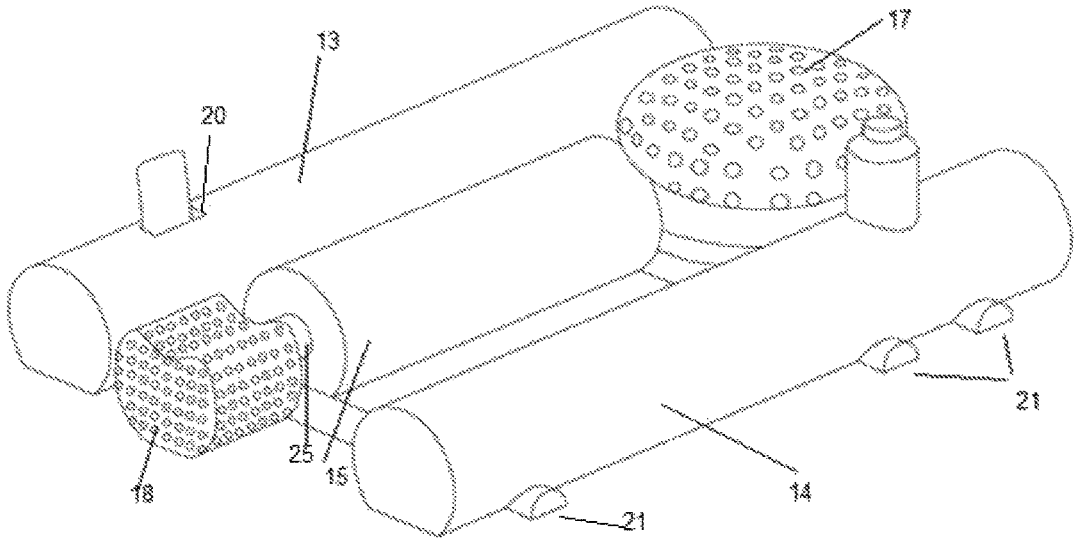
FIG. 4 is an illustrative diagram depicting the roller exercise device in an alternate embodiment of the present invention.

FIG. 4 displays a view of an embodiment of the present invention wherein the cylindrical core roller member 15 is positioned parallel to the right roller support member 13 and the left roller support member 14.

Figure 5:
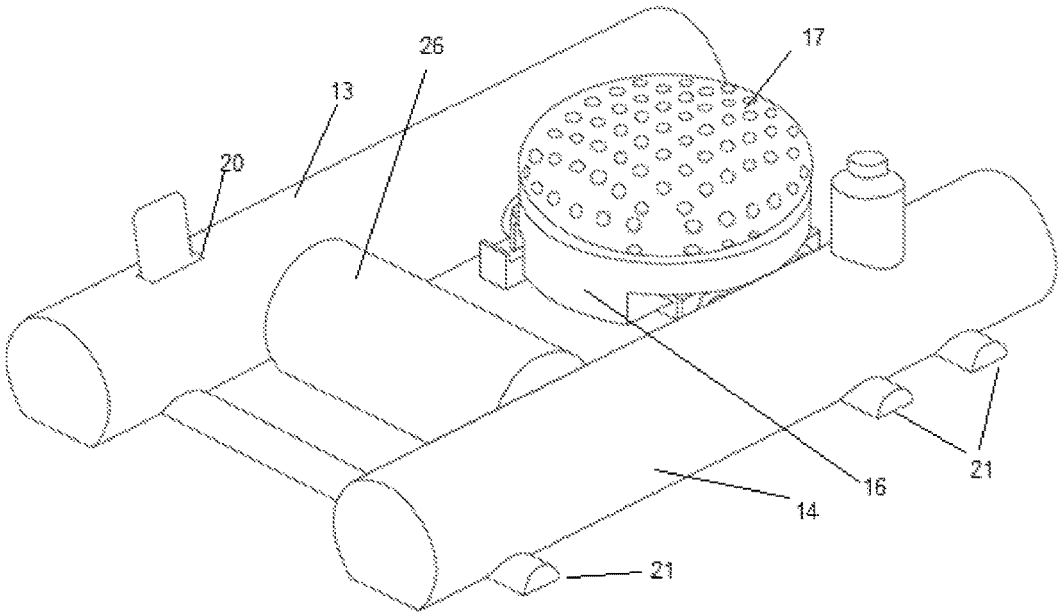
FIG. 5 is an illustrative diagram depicting the roller exercise device in an alternate embodiment of the present invention.

FIG. 5 displays a view of an alternate embodiment of the present invention wherein the cylindrical core roller member 15 is positioned perpendicular to the right roller support member 13 and the left roller support member 14.

In alternate embodiments of the invention, the cushion member 17 and the head rest unit 18 are provided with a textured surface.

Accordingly the present invention in a main embodiment is a novel roller exercise device, that can be placed on a flat support surface, comprising:

a pair of roller support members, designated as a left roller support member and a right roller support member, each roller support member having a semi-cylindrical configuration and a flat side surface, such that the flat side surface is placed on the support surface;

a cylindrical core roller member configured to support at least a portion of a user's body above the support surface during an exercise activity, wherein the cylindrical core roller member is centrally and parallelly positioned in between the left roller support member and the right roller support member;

a bottom rest unit, said bottom rest unit further comprising of:

a cushion member, a cushion base member, a plurality of carriage wheels, a plurality of carriage track members, a plurality of bottom rest support members, a position locking means;

a head rest unit configured with a central depression, a core roller support member, configured as cylindrical elongated member, having a first end and a second end, wherein the core roller support member is coaxially positioned and connected to the head rest unit at the first end, and the cylindrical core roller member at the second end, such that cylindrical core roller member is coaxially rotatable around the core roller support member;

a base support assembly, said base support assembly further comprising a plurality of structural support members, wherein each structural support member has at least one flat surface configured to rest on the support surface and said plurality of structural support members are positioned below and non-removably attached to the left roller support member, the right roller support member, the cylindrical core roller member, the bottom rest unit and the head rest unit at predetermined locations.

In an alternate embodiment of the invention, the cylindrical core roller member is centrally and perpendicularly positioned in between the left roller support member and the right roller support member. In such an embodiment, the first end and the second end of the core roller support member are connected to and disposed within the left roller support member and the right roller support member correspondingly. The core roller support member may be secured to the left roller support member and the right roller support member by removable means or non-removable means, in alternate embodiments.

In another embodiment of the invention, a plurality of cylindrical core roller members is provided.

In an alternate embodiment, the cylindrical core roller is removable.

In an alternate embodiment, position and height of the bottom rest unit and the head rest unit can be adjusted to suit a user.

In an alternate embodiment, the left roller support member and the right roller support member cylindrical core roller are provided with cavities or openings configured to receive personal belongings of a user.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

In this application, the terminology 'embodiment' can be used to describe any aspect, feature, process or step, any combination thereof, and/or any portion thereof, etc.

Various modifications to the disclosed embodiments will be readily apparent to those skilled in the art and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

I claim:

1. A roller exercise device, capable of being placed on a flat support surface, comprising:

a pair of roller support members, designated as a left roller support member and a right roller support member, each roller support member having a semi-cylindrical configuration and a flat side surface, such that the flat side surface is placed on the support surface;

a cylindrical core roller member configured to support at least a portion of a user's body above the support surface during an exercise activity, wherein the cylindrical core roller member is centrally and parallelly positioned in between the left roller support member and the right roller support member;

a bottom rest unit, said bottom rest unit further comprising:

a cushion member, a cushion base member, a plurality of carriage wheels, a plurality of carriage track members, a plurality of bottom rest support members, a position locking means wherein the position locking means comprises a mechanical fastener to secure the bottom rest supports with carriage track members;

a head rest unit configured with a central depression, a core roller support member, configured as cylindrical elongated member, having a first end and a second end, wherein the core roller support member is coaxially positioned and connected to the head rest unit at the first end, and the cylindrical core roller member at the second end, such that cylindrical core roller member is coaxially rotatable around the core roller support member;

a base support assembly, said base support assembly further comprising a plurality of structural support members, wherein each structural support member has at least one flat surface configured to rest on the support surface and said plurality of structural support members are positioned below and non-removably attached to the left roller support member, the right roller support member, the cylindrical core roller member, the bottom rest unit and the head rest unit at predetermined locations.

2. The roller exercise device as claimed in claim 1, further comprising a plurality of cylindrical roller members.

3. The roller exercise device as claimed in claim 1, wherein the cylindrical core roller member is removable.

4. The roller exercise device as claimed in claim 1, wherein the left roller support member and the right roller support member are provided with a cavity.

5. The roller exercise device as claimed in claim 1, wherein the cushion member and the head rest unit are provided with a textured surface.

6. The roller exercise device as claimed in claim 1, wherein the position and height of the bottom rest unit is configured to be adjusted to suit a user.

7. A roller exercise device, capable of being placed on a flat support surface, comprising:

a pair of roller support members, designated as a left roller support member and a right roller support member, each roller support member having a semi-cylindrical configuration and a flat side surface, such that the flat side surface is placed on the support surface;

a cylindrical core roller member configured to support at least a portion of a user's body above the support surface during an exercise activity, wherein the cylindrical core roller member is perpendicularly positioned in between the left roller support member and the right roller support member;

a bottom rest unit, said bottom rest unit further comprising:

a cushion member, a cushion base member, a plurality of carriage wheels, a plurality of carriage track members, a plurality of bottom rest support members, a position locking means wherein the position locking means comprises a mechanical fastener to secure the bottom rest supports with carriage track members;

a core roller support member, configured as cylindrical elongated member, having a first end and a second end, wherein the first end of the core roller support member is connected to the left roller support member, and the second end of the core roller support member is connected to the right roller support member;

a base support assembly, said base support assembly further comprising a plurality of structural support members, wherein each structural support member has at least one flat surface configured to rest on the support surface and said plurality of structural support members are positioned below and non-removably attached to the left roller support member, the right roller support member, the cylindrical core roller member, and the bottom rest unit at predetermined locations.

8. The roller exercise device as claimed in claim 7, wherein the left roller support member and the right roller support member are provided with a cavity.

9. The roller exercise device as claimed in claim 7, wherein the position and height of the bottom rest unit is configured to be adjusted to suit a user.

* * * * *